US006290243B1

(12) United States Patent
Beran

(10) Patent No.: US 6,290,243 B1
(45) Date of Patent: Sep. 18, 2001

(54) ANGULAR DISPLACEMENT CONTROL APPARATUS AND METHOD FOR ROTATIONALLY ADJUSTABLE SNOWBOARD BINDINGS

(75) Inventor: Mark A. Beran, Niwot, CO (US)

(73) Assignee: BC Creations, Inc., Niwot, CO (US)

( * ) Notice: Subject to any disclaimer, the term of this patent is extended or adjusted under 35 U.S.C. 154(b) by 0 days.

(21) Appl. No.: 09/518,525

(22) Filed: Mar. 4, 2000

(51) Int. Cl.[7] ..... A63C 9/00
(52) U.S. Cl. ..... 280/14.24; 280/607
(58) Field of Search ..... 280/607, 617, 280/618, 14.21, 14.22, 14.23, 14.24

(56) References Cited

U.S. PATENT DOCUMENTS

| | | | |
|---|---|---|---|
| 921,457 | 5/1909 | Purdum . | |
| 970,751 | 9/1910 | Pranke . | |
| 1,479,871 | 1/1924 | Pearson . | |
| 2,955,300 | 10/1960 | Hedlund et al. . | |
| 4,604,070 | 8/1986 | McKee et al. . | |
| 4,871,337 | 10/1989 | Harris . | |
| 5,021,017 | 6/1991 | Ott . | |
| 5,028,068 | 7/1991 | Donovan . | |
| 5,035,443 | 7/1991 | Kincheloe . | |
| 5,044,654 | 9/1991 | Meyer . | |
| 5,085,455 | 2/1992 | Bogner et al. . | |
| 5,236,216 | 8/1993 | Ratzek . | |
| 5,261,689 | 11/1993 | Carpenter et al. . | |
| 5,277,635 | 1/1994 | Gillis . | |
| 5,354,088 | 10/1994 | Vetter et al. . | |
| 5,356,170 | 10/1994 | Carpenter et al. . | |
| 5,381,747 | 1/1995 | Hinde . | |
| 5,416,952 | 5/1995 | Dodge . | |
| 5,433,636 | 7/1995 | Gillis . | |
| 5,499,837 | 3/1996 | Hale et al. . | |
| 5,520,406 | 5/1996 | Anderson et al. . | |
| 5,544,909 | 8/1996 | Laughlin et al. . | |
| 5,553,883 | 9/1996 | Erb . | |
| 5,660,410 | 8/1997 | Alden . | |
| 5,667,237 * | 9/1997 | Lauer | 280/14.24 |
| 5,732,959 * | 3/1998 | Soejima | 280/14.24 |
| 5,762,358 | 6/1998 | Hale . | |
| 5,791,678 * | 8/1998 | Perlman | 280/14.24 |
| 5,810,370 | 9/1998 | Covert et al. . | |
| 5,820,139 | 10/1998 | Grindl . | |
| 5,941,552 | 8/1999 | Beran . | |
| 6,155,578 * | 12/2000 | Patterson | 280/607 |

FOREIGN PATENT DOCUMENTS

| | | |
|---|---|---|
| 432588A | 6/1991 | (EP) . |

* cited by examiner

*Primary Examiner*—Richard M. Camby
(74) *Attorney, Agent, or Firm*—Harold A. Burdick

(57) ABSTRACT

Apparatus and methods are provided for angular displacement control of rotationally adjustable snowboard bindings, the apparatus including an actuating lever at the binding that is movable between positions to control rotation of the binding. A latching assembly restricts movement of the actuating lever in at least one lever postition to assure non-movement of the actuating lever absent an active manipulation by the user of the latching assembly.

19 Claims, 5 Drawing Sheets

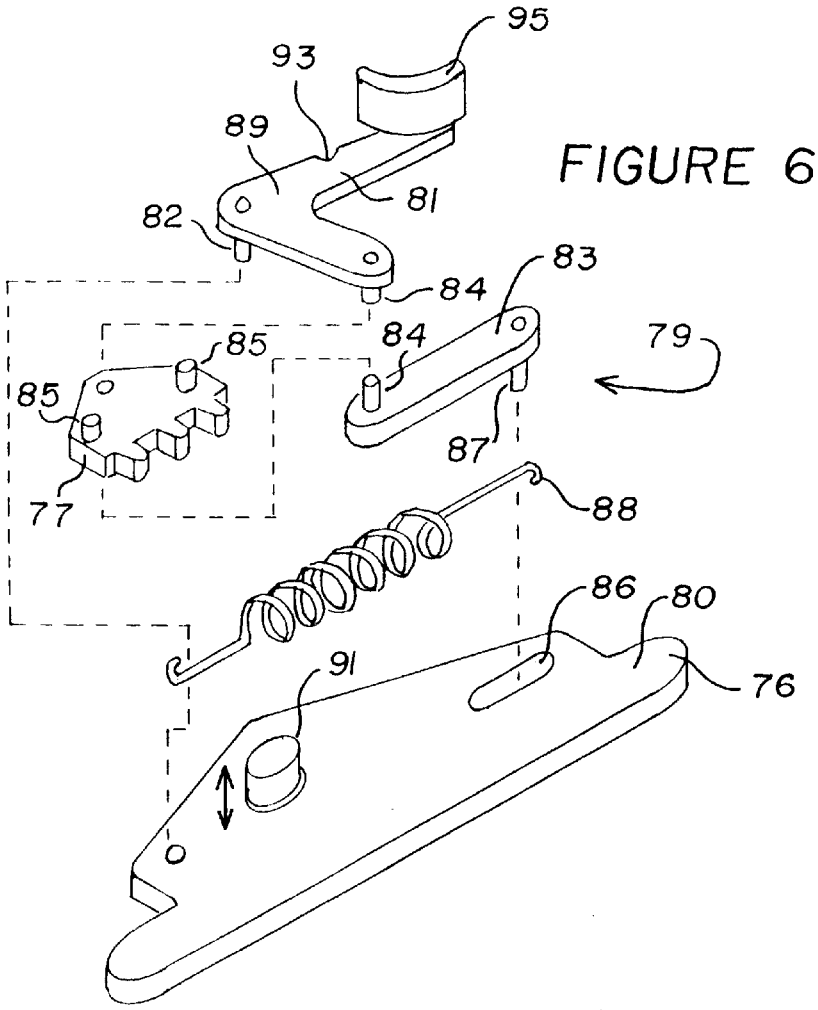
FIGURE 6
FIGURE 5
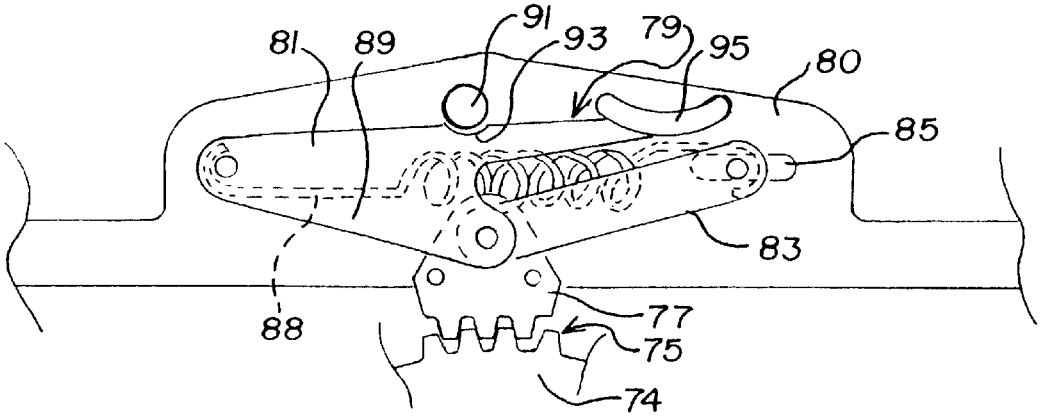

ANGULAR DISPLACEMENT CONTROL APPARATUS AND METHOD FOR ROTATIONALLY ADJUSTABLE SNOWBOARD BINDINGS

FIELD OF THE INVENTION

This invention relates to rotationally adjustable snowboard bindings, and, more particularly, relates to such binding systems allowing rotational adjustment of the rider's boot while in the binding relative to the surface of a snowboard.

BACKGROUND OF THE INVENTION

Snowboard bindings incorporate a central disk which is rigidly attached to the snowboard, the disk capturing and engaging a base plate of the binding through a central aperture therein. The base plate is thereby securely fastened to the snowboard. Snowboard binding designs are now available which allow the angular orientation of the base plate, and thus the angular orientation of a rider's foot held at the base plate, to be adjusted relative to the surface of the snowboard without requiring the removal of the binding from the snowboard (see, for example, U.S. Pat. Nos. 5,236,216, 5,354,088, 5,028,068). However, many of these designs require the removal of the boot from the binding in order to make the adjustment. Some allow the rotational adjustment while the boot remains secured at the base plate of the binding.

Rotationally adjustable bindings are highly desirable since use thereof allows a given rider's preferred orientation on the board to be readily established and or changed as conditions or preferences change without repositioning the entire binding, including binding fasteners anchored in the snowboard. This is particularly advantageous for equipment rental shops where frequent adjustments may be expected from one rental customer to the next, heretofore requiring removal of the binding fasteners from the board and reinsertion thereof corresponding to the new, preferred binding orientation resulting in undo wear and tear of inserts and at the surface of the snowboard and shorter rental equipment useful life.

Snowboard bindings that can be maintained in a substantially free rotational state are also advantageous allowing the rider to orient the binding so that the rider's foot is aligned parallel to the snowboard length (see U.S. Pat. No. 5,941,552). This establishes the board in a skating position which allows the rider to easily manipulate through ski lift lines and the like and to assume a more comfortable position while sitting on a lift chair. However, securement against release to the free rotational state must be provided. A system that allows such release by a single movement, action or force cannot be considered to be secure because of the possibility that any single force which will release the binding to free rotation can be replicated, and thus not precluded from inadvertent application, while a binding is in use (for example by collisions or use on particularly jarring or difficult terrain).

Heretofore known rotationally adjustable bindings have not provided a combination of features felt to be necessary to maximize the benefits of such bindings. Such bindings should combine ease of use (for example, allowing adjustment without boot removal and simplicity of switching from a free rotational state to a secure state, preferably a single action using the rider's rear, or free, boot), ability to maintain the binding in the free rotational state and adjustability of the level of resistance to rotation in that state, and security from inadvertent switching to the free rotational state from the secured, or stable, state. Further improvement could thus still be utilized.

SUMMARY OF THE INVENTION

This invention provides improved rotationally adjustable snowboard bindings and methods, and more particularly provides improved angular displacement control apparatus and methods for such bindings.

The apparatus and method provide a combination of features to maximize the benefits of such bindings, including ease of adjustment without boot removal and simplicity of switching from a free rotational state to a secured state (preferably a single action using the rider's rear, or free, boot), ability to maintain the binding in the free rotational state and adjustability of the level of resistance to rotation in that state, and security from inadvertent switching to the free rotational state from the secured, or stable, state.

Use of this invention provides for highly reliable securement of angular position of the binding to the snowboard, for quick, continuously adjustable, reorientation of the binding with respect to the snowboard without the necessity of removing or loosening the mounting screws or the rider's boot, and ease of return to an angularly secured position.

The angular displacement control apparatus includes an actuator at the binding having a portion that is movable between an engaged position and an unengaged position corresponding to a rotationally secured state of the binding and a substantially free rotational state of the binding, respectively. A latching mechanism is provided that acts at least at one of the positions to assure non-movement of the actuator portion absent active movement of the latching mechanism by a user.

The rotationally adjustable binding of this invention includes a disk and a base plate having an aperture therein, the disk and the base plate being relatively rotatable with either the disk or the base plate being anchored to the snowboard. A release and securement assembly is connected with the base plate for controlling relative angular displacement between the disk and base plate. The release and securement assembly includes a lever movable between positions corresponding to substantially free rotational and rotationally secured states of the disk and base plate, the latching mechanism acting in cooperation with the lever.

The method of this invention includes the steps of latching an actuator at the binding that is movable between an engaged position and an unengaged position corresponding to a rotationally secured state of the binding and a substantially free rotational state of the binding, respectively. At least at one of the positions non-movement of the actuator is assured by the latching absent active unlatching by a user.

Accordingly, it is an object of this invention to provide an improved rotationally adjustable snowboard binding apparatus and method.

It is another object of this invention to provide improved angular displacement control for rotationally adjustable snowboard bindings.

It is another object of this invention to provide rotationally adjustable snowboard binding apparatus and methods that combine features necessary to maximize the benefits of such bindings.

It is another object of this invention to provide rotational adjustment of snowboard bindings wherein ease of use, ability to maintain the binding in the free rotational state, and security from inadvertent switching to the free rotational state from the secured, or stable, state are combined.

It is still another object of this invention to provide apparatus and methods for allowing rotational adjustment of a snowboard binding without boot removal and having simplicity of switching from a free rotational state to a secured state, preferably by a single action using the rider's free boot.

It is another object of this invention to reduce rider stress and fatigue while riding chair lifts and maneuvering through lift lines by allowing quick changes of board position as dictated by the situation at hand, while providing hands-free board reorientation and return to a secured angular binding position.

It is still another object of this invention to provide an angular displacement control apparatus for a rotationally adjustable snowboard binding that includes an actuator at the binding including a portion movable between an engaged position and an unengaged position corresponding to a rotationally secured state of the binding and a substantially free rotational state of the binding, respectively, and a latching mechanism acting at least at one of the positions to assure non-movement of the portion absent active movement of the latching mechanism by a user.

It is yet another object of this invention to provide a rotationally adjustable binding for binding a user's boot to a top surface of a snowboard that includes a disk, a base plate having an aperture therein, the disk and the base plate being relatively rotatable, one of the disk and the base plate being anchored to the snowboard, a release and securement means connected with the base plate for controlling relative angular displacement between the disk and base plate, the release and securement means including a lever movable between positions corresponding to substantially free rotational and rotationally secured states of the disk and base plate, and a latching mechanism at the base plate acting at least at one of the positions in cooperation with the lever of the release and securement means to assure non-movement of the lever absent active movement of the latching mechanism by a user.

It is still another object of this invention to provide a method for angular displacement control of a rotationally adjustable snowboard binding including the steps of latching an actuator at the binding that is movable between an engaged position and an unengaged position corresponding to a rotationally secured state of the binding and a substantially free rotational state of the binding, respectively, so that at least at one of the positions non-movement of the actuator is assured absent active unlatching by a user.

With these and other objects in view, which will become apparent to one skilled in the art as the description proceeds, this invention resides in the novel construction, combination and arrangement of parts and method substantially as hereinafter described, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 5 is a side view illustration with ghosted portions showing the apparatus of this invention for use with a second type of rotationally adjustable snowboard binding;

FIG. 6 is an exploded view of the apparatus of FIG. 5;

DESCRIPTION OF THE INVENTION

Figure 1:
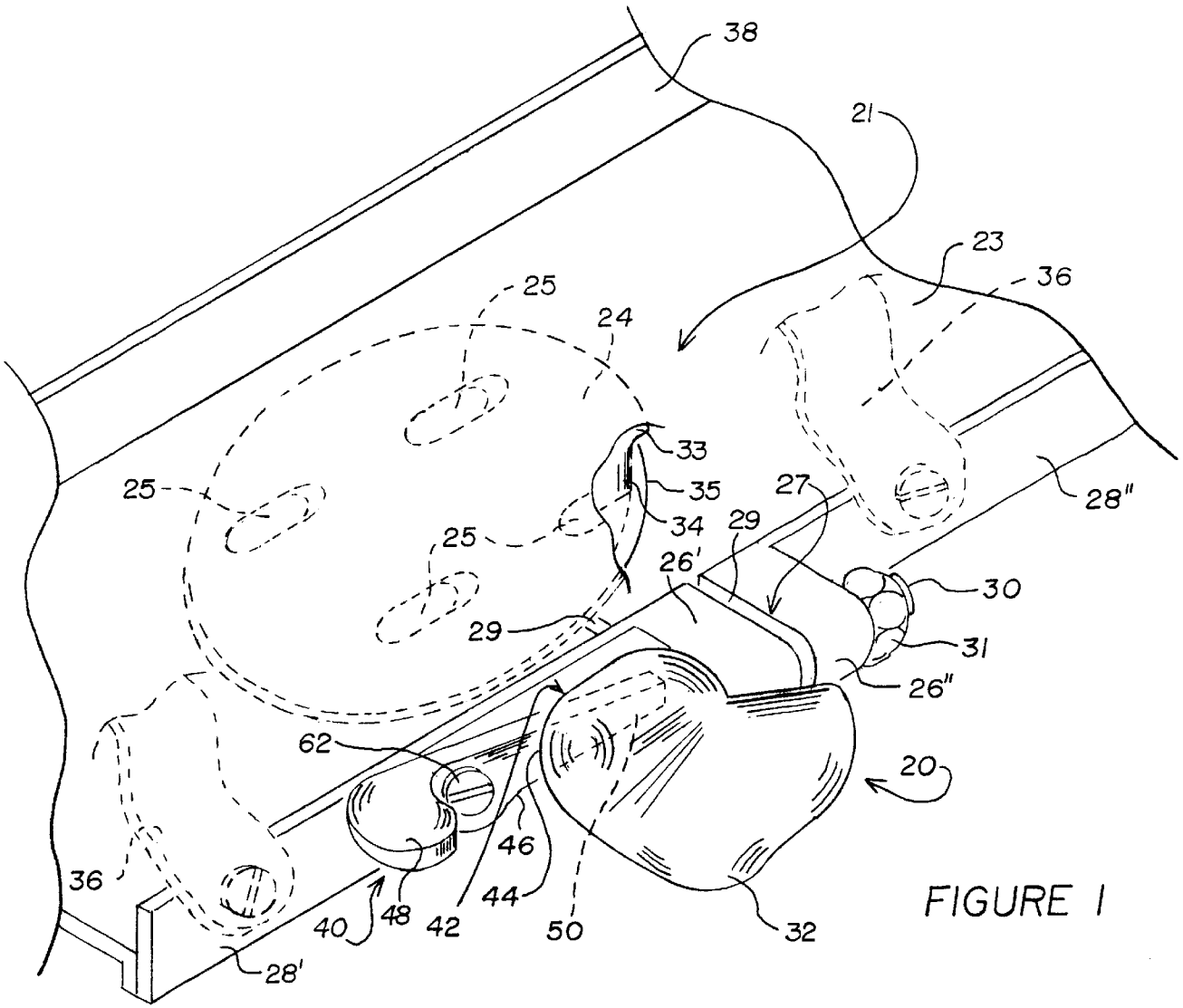
FIG. 1 is a perspective view showing the apparatus of this invention for use with a first type of rotationally adjustable snowboard binding.

The apparatus and method of this invention may be employed with a variety of rotationally adjustable snow board bindings, several types of which are shown in the drawings, it being understood that this invention may be adapted for use with still other such binding types. In FIGS. 1 through 4, apparatus 20 of this invention is illustrated for use with rotationally adjustable snowboard binding system 21 (of a type illustrated in U.S. Pat. No. 5,941,552).

Binding system 21 readily accommodates rotational binding release and securement while a user's boot is secured in the binding at the top surface of a snowboard. System 21 includes base plate 23 and securing disk 24 which is fastened to a snowboard by screws or the like through slots 25. Blocks 26' and 26" for holding release and securement assembly 27 are preferably integrally formed (in accord with another aspect of this invention) with flanges 28' and 28" of base plate 23, one on each side of slot 29. Assembly 27 includes mechanism 30, for example a slider mechanism linearly moveable within mounting blocks 26 with a close running fit (any appropriate camming mechanism could be used), one end of mechanism 30 secured by nut 31. The other end of mechanism 30 is threaded to receive manipulable actuating control, or lever, 32 configured to be movable by hand or boot.

Disk 24 includes shoulder 33 and arcuate shank 34 extending through opening 35 in base plate 23. Boot anchoring straps 36 are held at flanges 26 for securement of the boot to base plate 23 between flanges 28 and 38. When secured, binding base plate 23 is held between the top of the snowboard and the bottom surface of shoulder 33 of disk 24. When adjusted, since slot 29 is continuous from opening 35 and across base plate 23 and between flanges 28' and 28", when lever 32 is rotated (toward the top of the snowboard) slot 29 narrows and a clamping force is applied at shank 34 of disk 24 by the mating edge of opening 35 in base plate 23.

Preload nut 31 is selectively adjustable on mechanism 30 to reduce or increase the width of slot 29 until a desired locking force is developed between disk shank 34 and central opening 35 of base plate 23. At the same time, this adjustability feature allows selection of the relative freedom or restriction of rotation of base plate 23 around disk 24 when lever 32 is in the unsecured position (i.e., rotated away from the snowboard surface), thus allowing for relatively free rotation or a selected degree of frictional resistance to such rotation as a user may select.

Where a slider mechanism is used, the middle section of slider 30 and the bores through mounting blocks 26 have the same cross sectional shapes and are so designed that rotation of preload nut 31 or lever 32 does not cause slider 30 to rotate with respect to mounting blocks 26. Lever 32 has a central bore with internal threads to engage threads on slider 30 so that lever 32 advances or recedes axially with respect to slider 30 when rotated. Thus in this particular system, rotational change of boot position relative to the top of the snowboard is achieved when slot 29 is opened by rotation of lever 32 such that base plate 23 can be rotated with respect to disk 24. Moreover, a relatively free rotational state can be maintained until lever 32 is returned to the secured state position.

Turning now to apparatus 20 of this invention in use with the above-described system, the apparatus includes a latch assembly 40 in cooperation with lever 32. Lever 32 is specifically configured so that rotation of the lever downward, towards the surface of a snowboard, narrows slot 29 to secure base plate 23 at disk 24 and create gap 42 between end 44 of lever 32 and flange 28'. Rotation of lever 32 in the opposite direction, away from the snowboard surface, opens slot 29 and releases base plate 23 for relatively free rotation around disk 24, while closing gap 42 with end 44 abutting flange 28' (see FIG. 4).

Figure 2:
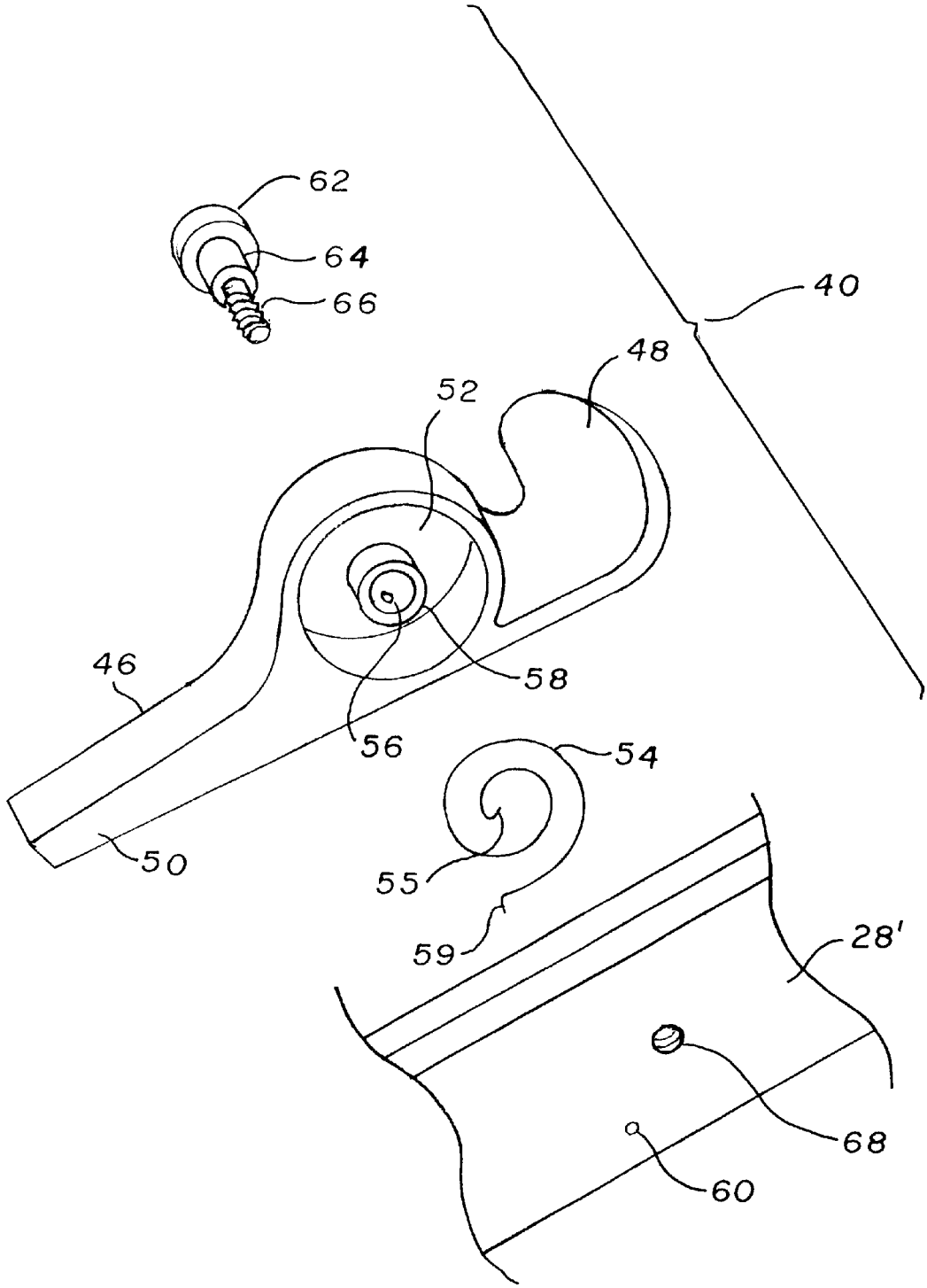
FIG. 2 is an exploded view of the latching mechanism of the apparatus of this invention shown in FIG. 1.
Figure 4:
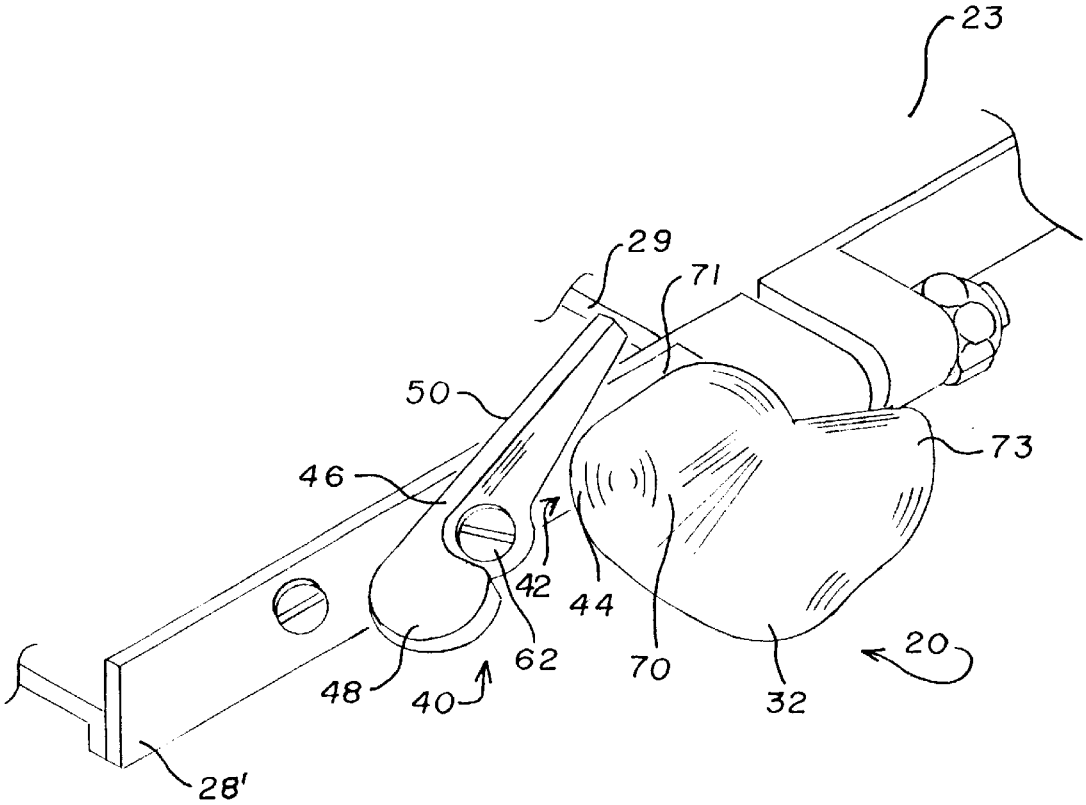
FIG. 4 is a perspective view illustrating release of the apparatus from the secured state of FIG. 1 for movement to the free rotational state.

As shown in FIG. 2 (a rotated exploded view), latching assembly 40 includes arm 46 with manipulable portion 48 and projecting portion 50 at opposite sides of spring housing 52. Bias spring 54 is coiled in housing 52 secured at one end 55 through aperture 56 in mounting stud 58 and at the other end 59 through aperture 60 at flange 28'. Securing screw 62 includes shoulder 64 for rotational interface with stud 58 and threaded end 66 for engagement at threaded bore 68 through flange 28'.

Figure 3:
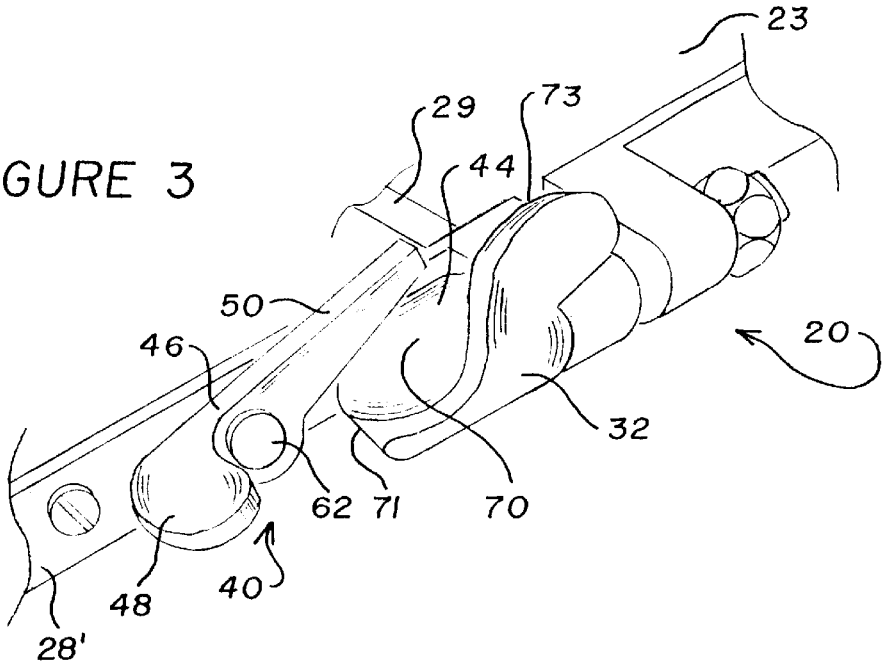
FIG. 3 is a perspective view illustrating the apparatus of FIG. 1 maintained in a free rotational state.

FIG. 3 shows lever 32 at the position corresponding to the free rotational state of the binding. In this position, the bias of spring 54 and configuration of lever 32 assures that projecting portion 50 of arm 46 is held against surface 70 of lever 32 which is abutting or nearly abutting flange 28' at end 44. When lever 32 in rotated toward the board (FIG. 4), flat portion 71 of end 44 is aligned facing flange 28' defining gap 42 between end 44 and flange 28', the gap being slightly larger than the thickness of projection portion 50 of arm 46. The bias of spring 54 moves arm 46 so that projecting portion 50 enters gap 42 (see FIG. 1) thus preventing movement of lever 32 absent movement of latch arm 46 by a rider depressing manipulable portion 48. Only then is lever 32 freed for user rotation from the position corresponding to the binding secured state to the position corresponding to the free rotational state.

Lever 32 is configured so that end 73 thereof is easily manipulatable by a user using the rider's free boot. In this way, the binding may be secured by the single action of a rider stepping down on end 73 to rotate lever 32 toward the board, latch assembly 40 moving into place to hold lever 32 thereat. On the other hand, the rider cannot merely kick lever 32 to cause rotation to a position corresponding to the free rotational state. This requires two distinct actions by the rider, depressing manipulable portion 48 of arm 46 (countering the bias of spring 54) to move projecting portion 50 out of gap 42 followed by rotation of lever 32. This requirement provides security against inadvertent disengagement of base plate 23 during normal use of the snowboard.

FIGS. 5 and 6 show the apparatus of this invention for use with a binding of the type having a rotatable disk 74 (corresponding to disk 24 shown in FIG. 1) to which the rider's boot is affixed interlocked mechanically at gear-like teeth 75. As now manufactured, bindings of this type include an actuator at a base plate having a slidable lever with engaging teeth at one end of the actuator rotationally fixed relative to the snowboard surface. The engaging teeth are movable (linearly) against a spring bias (always biasing the teeth into engagement at teeth 75 of disk 74) to disengage the teeth and allow relatively free rotation of the disk so long as manually held out of engagement. Thus, rotational adjustment is allowed, but not maintenance of disengagement of the teeth. There is, therefore, nothing provided allowing maintenance of a free rotational state in this type of binding.

The invention includes a modified version of the slidable lever in the form of an articulated rack of teeth 77, together with a latching assembly 79 all maintained at a mount 80 fixed relative to the board's surface. Latching assembly arm 81 is pivotally maintained at mount 80 by pivot pin 82 and pivotably mounted to follower 83 at pins 84 pivotably holding rack 77 therebetween. Movement of rack 77 is constrained by pins 85 significantly shortening the available rotational arc. The opposite end of follower 83 is slidably constrained in slot 86 by pin 87.

When arm 81 is rotated to rotationally secure and release the binding, rack 77 moves in an essentially linear fashion to engage and disengage teeth 75 (the short are available in rack motion provided to allow for centering difficulties encountered upon release and reengagement of the teeth, a difficulty present in such bindings as now produced). Spring 88 is held between pins 82 and 87 and assures latching assembly 79 snaps into position as lever end 89 passes it (i.e., the rotationally secured state as shown in FIG. 5). As arm 81 moves past articulated (i.e., spring mounted in a detent in mount 80) latch pin 91 in the clockwise direction toward rotational securement, pin 91 snaps up under spring force and into engagement at depression 93 at arm 81 to prevent reverse rotation absent a user pressing down pin 91 into the detent and counter clockwise movement of arm 81 to overcome spring 88. Once lever end 89 clears spring 88 during counter clockwise travel, spring 88 serves to hold arm 81, in the position corresponding to the free rotational state with rack 77 out of engagement with teeth 75 of disk 74. In this position, pin 91 is held in its detent by arm 81. Reengagement of the binding may be accomplished by the rider moving arm 81 at manipulable end 95 (with his free boot) to cause clockwise rotation.

Figure 8:
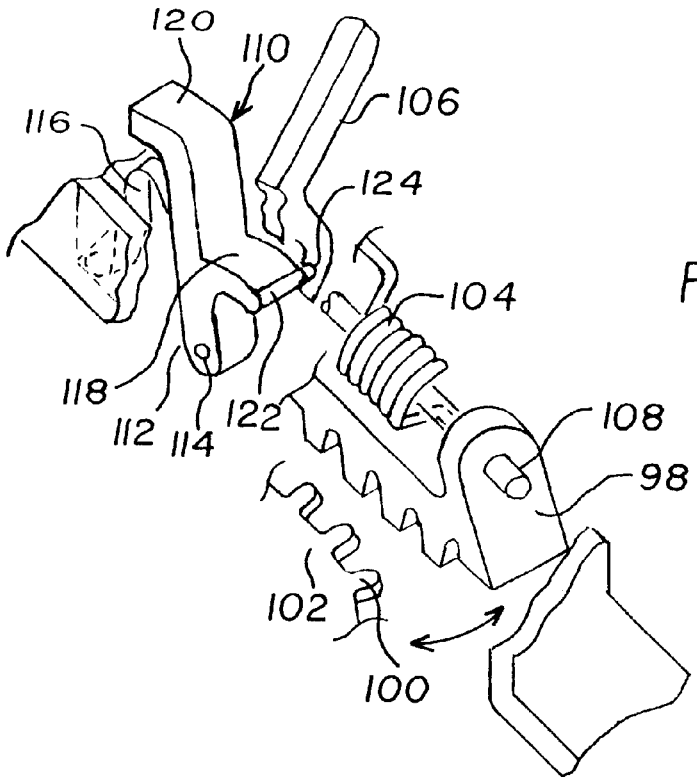
FIG. 8 is a perspective view with cutaway portions illustrating operation of the apparatus of FIG. 7.
Figure 7:
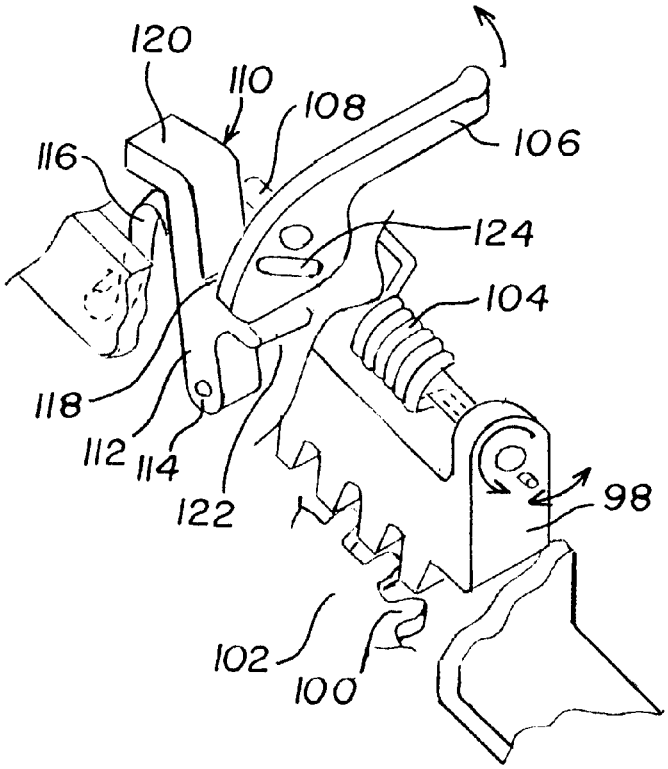
FIG. 7 is a perspective view illustration showing the apparatus of this invention for use with a third type of rotationally adjustable snowboard binding.

FIGS. 7 and 8 show the apparatus of this invention for use with a binding of yet another type wherein rack 98 is moved by rotational forces into and out of engagement with teeth 100 of fixed disk 102. As now produced, rack 98 is biased into engagement with teeth 100 by spring 104 and thus free rotation is not provided for. Lever 106 is rotatable by a user on shaft 108 in the direction shown (against spring bias) to cause disengagement of rack 98 and teeth 100 as rack 98 swings away.

The invention herein includes modification of lever 106 and provision of latching assembly 110. Assembly 110 includes arm 112 pivotably mounted to the binding at pin 114. Arm 112 is biased toward engagement by flat or leaf spring 116. Surface 118 of arm 112 is slightly curved and provides restraint preventing lever 106 from being rotated to a position where rack 98 becomes disengaged from teeth 100 (corresponding to the rotationally secured state). Only when arm 112 is depressed at manipulable end 120, and surface 118 thus pivots out of engagement with lever 106, can lever 106 be moved by a user. When so moved, pawl 122 rides on the rear surface of lever 106 until lever slot 124 is encountered. When slot 124 and pawl 122 are aligned, pawl 122 snaps into the slot the holding lever 106 (and thus rack 98) in a position corresponding to a free rotational state with disk teeth 100 disengaged from the rack 98 (see FIG. 8). To reengage the binding in the secured state, the rider merely depresses manipulable portion 120 of arm 112 (using the free boot, for example) thus allowing lever 106 to be rotationally biased by spring 104 to the position shown in FIG. 7 with rack 98 engaged at teeth 100.

As may be appreciated from the foregoing, improved angular displacement control is provided by the apparatus and methods of this invention for use with rotationally adjustable snowboard bindings. No matter the particular application of this invention with the various types of rotationally adjustable bindings, all include latching deployed in cooperation with the lever or other control mechanism used to rotationally release and resecure the binding (either modified or unmodified) to assure stability of the binding in the rotationally secured state and to maintain relatively free rotation of the binding in a rotational state.

What is claimed is:

1. Angular displacement control apparatus for a rotationally adjustable snowboard binding comprising:

an actuator at the binding including a portion movable by a user between an engaged position and an unengaged position corresponding to a rotationally secured state of the binding and a substantially free rotational state of the binding, respectively; and a latching mechanism at the binding including a user manipulable portion and biasing means for biasing said latching mechanism into engagement adjacent to said portion of said actuator at least at one of said positions, said latching mechanism acting at said at least one of said positions to assure non-movement of said portion absent active movement of said manipulable portion of said latching mechanism by a user.

2. The apparatus of claim 1 further comprising adjustable rotational restricting means at said actuator for adjusting resistance to free binding rotation when said portion is at said unengaged position.

3. The apparatus of claim 1 wherein said latching mechanism includes means for holding said portion of said actuator at said unengaged position to maintain said portion thereat.

4. The apparatus of claim 1 wherein said user manipulable portion of said latching mechanism includes an arm, said arm biased by said biasing means toward engagement adjacent to said portion of said actuator without user manipulation when said portion of said actuator is moved from said unengaged to said engaged position, disengagement of said arm therefrom requiring user movement of said arm by action at another part of said manipulable portion.

5. The apparatus of claim 1 wherein said portion of said actuator is structured to hold said latching mechanism out of operative engagement therewith when said portion is at said unengaged position.

6. A rotationally adjustable binding for binding a user's boot to a top surface of a snowboard comprising:

a disk;

a base plate having an aperture therein, said disk and said base plate being relatively rotatable, one of said disk and said base plate being anchored to the snowboard;

release and securement means connected with said base plate for controlling relative angular displacement between said disk and base plate, said release and securement means including a lever movable by a user between positions corresponding to substantially free rotational and rotationally secured states of said disk and base plate; and a latching mechanism at the base plate including a user manipulable portion and biasing means for biasing said latching mechanism into engagement adjacent to said lever of said release and securement means at least at one of said positions, said latching mechanism acting at said at least one of said positions in cooperation with said lever of said release and securement means to assure non-movement of said lever absent active movement of said manipulable portion of said latching mechanism by a user.

7. The binding of claim 6 wherein said lever is configured so that a gap is defined between a portion of said lever and said base plate when said lever is moved to one of said positions and so that said gap is closed when said lever is moved to the other of said positions, said gap for receipt therein of one part of said latching mechanism.

8. The binding of claim 6 wherein said base plate is rotatable and said disk is anchored, said base plate configured to be supported by the top surface of the snowboard and to receive the user's boot thereat, said base plate having an outer edge, a continuous slot being formed between said aperture and said outer edge thus defining first and second base plate portions at each side of said slot, said slot having a width between said base plate portions, said release and securement means connected at each side of said slot for selectively governing said width of said slot and thereby govern contact between said aperture and said disk by user movement of said lever between said positions, said base plate rotatable around said disk when said lever is moved to said position corresponding to said free rotational state and secured from rotation around said disk when said lever is moved to said position corresponding to said rotationally secured state, said latching mechanism including an arm biased toward engagement adjacent to said lever of said release and securement means without user manipulation when said lever is moved from said position corresponding to said substantially free rotational state to said position corresponding to said rotationally secured state.

9. The binding of claim 6 wherein said disk and said release and securement means both have selectively engageable teeth, said latching mechanism including means for holding said lever of said release and securement means at said position corresponding to said free rotational state to maintain said teeth of said disk and said release and securement means out of engagement.

10. The binding of claim 9 wherein said latching mechanism includes a manipulable portion to accommodate movement of said lever from said position corresponding to said substantially free rotational state to said position corresponding to said rotationally secured state in a hands-free manner.

11. The binding of claim 6 wherein said disk is rotatable and said base plate is anchored.

12. A method for angular displacement control of a rotationally adjustable snowboard binding comprising latching a user manipulable actuator at the binding that is movable between an engaged position and an unengaged position corresponding to a rotationally secured state of the binding and a substantially free rotational state of the binding, respectively, so that at least at one of said positions non-movement of said actuator is assured absent active unlatching by a user followed by active actuator manipulation by a user.

13. The method of claim 12 wherein hands-free movement of said actuator from said unengaged to said engaged position is accommodated.

14. The method of claim 12 wherein active unlatching includes the step of manual movement of a latching mechanism before movement of said actuator from said engaged to said unengaged position can occur.

15. The method of claim 12 wherein the step of latching said actuator includes holding said actuator at said unengaged position to selectively maintain said actuator thereat.

16. The method of claim 12 wherein the step of latching said actuator includes biasing a latching mechanism into engagement adjacent to said actuator when at said engaged position to secure said portion thereat against inadvertent movement.

17. The method of claim 12 further comprising configuring said actuator so that no latching occurs when said actuator is at said unengaged position.

18. The method of claim 12 further comprising adjustably restricting free binding rotation when said actuator is at said unengaged position.

19. The method of claim 12 further comprising the step of latching said actuator when said actuator is moved to either of said positions to assure non-movement of said actuator absent active unlatching by a user.

* * * * *